United States Patent [19]

Hesse et al.

[11] 4,416,139

[45] Nov. 22, 1983

[54] GUIDING A MANDREL OR PUNCH FOR PIERCING OR COLD-EXTRUSION

[75] Inventors: Heinrich Hesse; Anton Merkler; Siegfried Gross; Gerhard Radtke, all of Bielefeld, Fed. Rep. of Germany

[73] Assignee: Mannesmann Aktiengesellschaft, Düsseldorf, Fed. Rep. of Germany

[21] Appl. No.: 268,801

[22] Filed: Jun. 1, 1981

[30] Foreign Application Priority Data

May 8, 1980 [DE] Fed. Rep. of Germany ..... 3017821

[51] Int. Cl.[3] ..... B21C 23/20; B21C 26/00

[52] U.S. Cl. ..... 72/267; 72/272; 72/273

[58] Field of Search ..... 72/264, 266, 267, 273, 72/253.1, 354, 471

[56] References Cited

U.S. PATENT DOCUMENTS

| | | | |
|---|---|---|---|
| 603,787 | 5/1898 | Holinger | 72/267 |
| 629,817 | 8/1899 | Prym | 72/267 |
| 1,024,840 | 4/1912 | Ehrhardt | 72/267 |
| 2,812,673 | 11/1957 | Harter | 72/354 |
| 3,280,613 | 10/1966 | Schrom | 72/344 |
| 4,362,043 | 12/1982 | Hanson | 72/354 |

FOREIGN PATENT DOCUMENTS

| | | | |
|---|---|---|---|
| 475195 | 9/1975 | Australia | 72/267 |
| 1318360 | 1/1963 | France | 72/267 |
| 53-82650 | 7/1978 | Japan | 72/264 |
| 588033 | 1/1978 | U.S.S.R. | 72/266 |
| 759190 | 9/1980 | U.S.S.R. | 72/267 |

*Primary Examiner*—Lowell A. Larson
*Attorney, Agent, or Firm*—Ralf H. Siegemund

[57] ABSTRACT

A piercing mandrel or punch, particularly for backward extrusion, is guided by a member which centers the mandrel or punch in the upper die cavity and is coupled thereto until abutting a centering shoulder in the die cavity; the guiding and centering function continues as the mandrel or punch begins and progresses in the cold flow-working process.

4 Claims, 4 Drawing Figures

GUIDING A MANDREL OR PUNCH FOR PIERCING OR COLD-EXTRUSION

BACKGROUND OF THE INVENTION

The present invention relates to supporting and guiding a punch or mandrel for punching presses, cold extrusion molding, or the like; in particular, for backward extrusion of hollows.

Guiding a mandrel or punch during piercing of a blank or of the die punch or mandrel during backward cold extrusion is a rather critical requirement in order to avoid eccentric deformation of the work. Usually, the mandrel or punch is guided by a load-bearing support in the upper tool portion so that underneath the work can still be displaced laterally, particularly in the first phase of piercing. This, however, is the most critical situation as a very accurate centering of this initial piercing and identifying step is a prerequisite for obtaining uniform wall thickness over the entire length of the work.

DESCRIPTION OF THE INVENTION

It is an object of the present invention to provide a new and improved guide structure for mandrels and punches, particularly to ensure centering thereof in the initial phases of press-working, such as piercing and/or cold extrusion.

In accordance with the preferred embodiment of the present invention, it is suggested to provide an annular centering structure to be received in the upper portion of a die cavity and receiving the mandrel or punch. The die cavity has a centering surface, and the annular centering structure is provided with a matching surface. The annular structure has also an internal shoulder by means of which that structure sits on the rear end shoulder of the mandrel or punch head. The mandrel or punch stem is releasably locked to the annular structure, unlocking to occur when the front end of the annular structure abuts a centering surface of the die; but the mandrel or punch is continued to be advanced.

The annular structure may be comprised of two coaxial, interconnected annular members which are axially displaceable to each other, whereby the front member is contoured to have a centering front end and includes a structure for unlocking the rear member from the stem as the stem is advanced.

The inventive guide system is particularly effective in the initial phase of piercing and avoids eccentric onset of material flow and distribution. The guide system sits right on the head of the punch or mandrel which will, in fact, project from that guide as the cold-working begins. The guide structure will remain in a forward-most position for centering the mandrel or punch until being lifted by backflow of worked material. This occurs when the working is well in progress, and the centering has already taken effect. This aspect is clearly of particular advantage when the resulting product is rather long, such as one-half meter or even one-meter-and-a-half, or thereabouts.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 illustrates a mandrel or punch having a shank, stem, or rod 3, and a head 4 with a piercing tip 4*a* which provides for initial piercing. Reference numeral 9 refers to a die having a lower cavity 9*a* for receiving the work or blank 10 and an upper, cylindrical portion 16 of a wider diameter.

Figure 1:
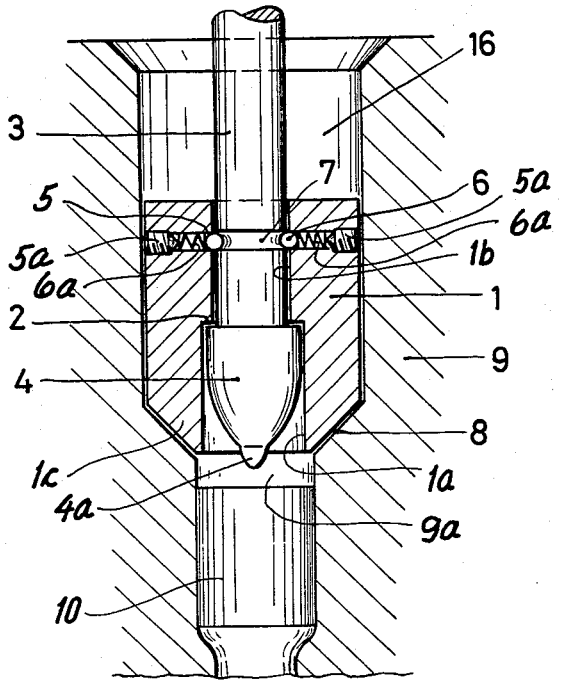
FIG. 1 is a section view through a die and punch, including a single-piece guide element.

The mandrel or punch is guided in an annular or tubular member 1 having a lower portion 1*a* of a wider diameter for receiving the punch or mandrel head 4 amd a narrower portion 1*b* for the stem or rod 3. Externally, the member 1 is provided with a conical or frusto-conical 1*c* which may bear against a matching centering surface 8 of die 9. In other words, the die cavity has a transition portion between cavity 9*a* and portion 16 which is defined by a frusto-conical centering surface 8 for a matching surface on the front end of the guide member 1.

The transition between portions 1*a* and 1*b* defines a collar 2 which initially bears against the head 4 from the rear without further measures; the annular centering member just sits on the rear shoulder of head 4 and centers the mandrel or punch inside cavity 16.

The guide member 1 is provided with a plurality of radial ducts 5, plugged outwardly by means of screws 5*a* which bear against springs 6*a*. These springs respectively urge balls 6 into an annular groove 7 of stem or shank 3. Thus, the axial position of guide member 1 is determined by the centering conical shoulder 8 of die 9, the radial position of guide member 1 (and, therefore, of the mandrel or punch) is determined by the fit of that member in cavity 16 so that the radial (eccentric versus centric) position of the mandrel is, thus, determined by the accuracy of that fit which, in turn, determines the centering accuracy of the mandrel in relation to the work in cavity 9*a*, being a continuation of cavity 16. The (axial) position of the mandrel or punch in guide member 1 is determined by the balls 6 and related and cooperating elements.

It can, thus, be seen that the mandrel or punch is, initially, held centrally by guide member 1 inside the wide cavity portion 16. The piercing mandrel is advanced inside cavity 16, toward the blank 10, while being coupled to the guide member. This guide member advances, centered in cavity 16, until abutting surface 8. Further advance of the mandrel or punch decouples it from guide member 1. For backward extrusion, punch $\frac{3}{4}$ is advanced further and pierces initially blank 10 while being guided in the now stopped guide member 1. This guiding continues upon further advance through the guide member, throughout the extrusion backflow of material will lift guide member 1 off the centering surface. At this point, centering is well advanced and needs little further guidance.

Figure 2:
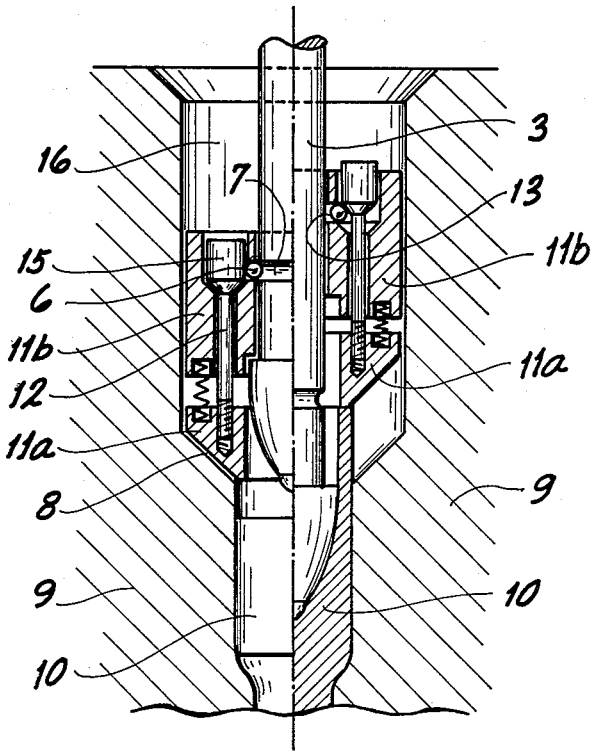
FIG. 2 is a similar view, but of a two-part guide structure.

Turning now to FIG. 2, die, work, and mandrel or punch are the same as before. However, the guide member is constructed differently. It includes a lower ring 11*a* and an upper ring 11*b*; these rings are interconnected by springs and, additionally, in a positioning and one-way fashion by spacer bolts 12. These bolts have threaded front end portions to be threaded into annulus 11*a*. The springs control the extent of proximity of the members 11*a* and 11*b* to each other, tending to spread the rings 11*a* and 11*b* apart. The heads 15 on pins 12 limit the extent of axial separation of the members.

The member 11*b* is provided with short radial ducts 13 for receiving the balls 6 which may enter the groove 7, as described above. As stated earlier, the pins or bolts 12 are provided with heads 15 of a larger diameter. The ring member 11*b* has bores of matching contour, there being shoulders accordingly against which may rest, in each instance, a conical transition of a pin from head 15 to the stem. These conical transitions of heads 15 are actually operating surfaces for the balls 6 in ducts 13.

When head 15 rests on the respective shoulder, it bears against a ball 6 and locks it in groove 7 so that the mandrel or punch is locked in that position relative to ring member 11*b*. This position, moreover, requires spreading of members 11*a* and 11*b* to maximum separation. Upon advance of mandrel ¾ with member 11*b* coupled thereto while the springs tend to spread member 11*a* away from member 11*b*, the mandrel tip is centrally advanced towards the blank until the conical tip of member 11*a* rests against die shoulder 8, as illustrated in the left-hand portion of the figure.

The interrelational step between parts ¾ and member 11*a* and 11*b* is as depicted throughout this initial phase in which this assembly is advanced inside the upper cavity 16, but member 11*a* will stop when bearing against shoulder 8.

Continuous advance of mandrel or punch ¾ causes the member 11*b* to be advanced toward member 11*a*, while the pins 12 stay in position. Accordingly, head 15 is displaced relative to member 11*b* and will free balls 6 to, thereby, unlock the mandrel from the guide member assembly. The mandrel ¾ is now no longer coupled to the guide member, but is still guided by it until the backflow of extruded material from the blank lifts the guide member off shoulder 8.

Figure 3:
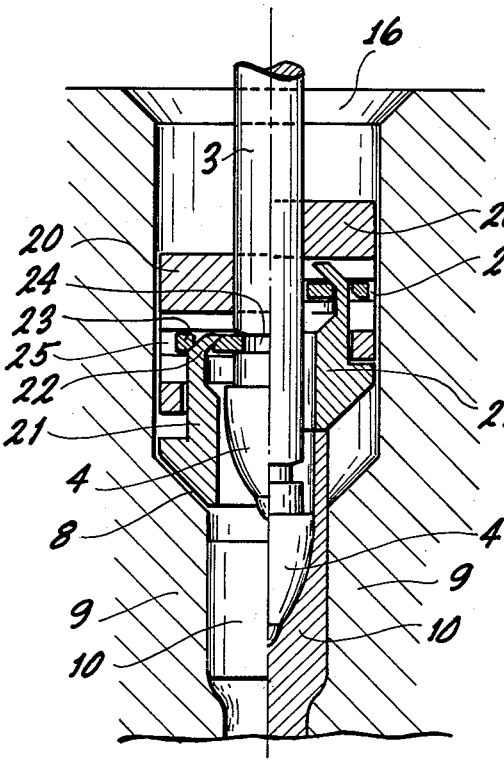
FIG. 3 is a split view similar to FIG. 2, but showing modifications in a two-part guide structure.
Figure 4:
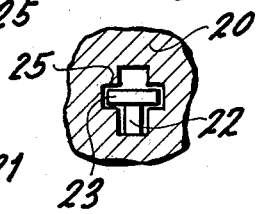
FIG. 4 is a section view of a detail of FIG. 3.

The assembly as per FIGS. 3 and 4 replaces the ball's lock of FIG. 2 with slide locks 23. These lock members 23 run in flat, radial grooves 25. Basically, a single lock member may suffice, but multiple members are preferred and are presently assumed for this description. The slide members are moved laterally by conical upward extensions 22 of the lower guide member 21. The front end of member 21 is conically contoured for centering on conical shoulder 8 of the die. The upper guide member 20 receives telescopically the upper part of lower guide member 21.

The locking position is depicted in the left-hand portion of FIG. 3. The particular locking member 23 as depicted has (axially) a fixed position to upper guide member 20 because it runs in slots 25 of member 20 (see FIG. 4). Thus, as the mandrel or punch is inserted in the die cavity, the member 20 is coupled to rod 3 by means of the lock's (23) insertion in groove 24 of rod 3 while member 21 hangs on the locks. Therefore, the various parts have the disposition as shown in this left-hand portion until the conical tip of member 21 abuts shoulder 8. Further insertion of the punch or mandrel moves members 20 and 23 axially, relative to stopped member 21, causing members 23 to glide on the cam surface 22 so that members 23 move radially outward, thereby unlocking member 20 from the rod or stem 3. The mandrel can now move freely inside the two members 20 and 21; member 20, in fact, drops onto member 21. onto member 21. Subsequently, extrusion begins and the upwardly flowing material from blank 10 will lift members 20 and 21.

It can, thus, be seen that the inventive guide system permits the guide member(s) for the mandrel or punch to be moved in a centered position until being close to the work, whereupon the punch or mandrel decouples from the guide, but continues to be centrally guided by and in the centered guide member. The guide member may be lifted by displaced and flowing material; but even then, it continues its guiding function. However, as the working progresses, the external centering becomes less and less important as the mandrel head is guided by and in the properly centered indent it produces in the work 10, particularly as the material flows upwardly along the mandrel's head.

The invention is not limited to the embodiments described above; but all changes and modifications thereof, not constituting departures from the spirit and scope of the invention, are intended to be included.

We claim:

1. Device for guiding a punch or mandrel in a die cavity, the punch or mandrel having a stem and a head on the stem, the head having a larger diameter than the stem, defining a shoulder accordingly, comprising:

annular means receiving a portion of the stem and of the head and having a shoulder by means of which the annular means can be seated on the shoulder of the head, the annular means including a first front end member, and a second rear member displaceably connected to the front member;

said die cavity having a centering surface, said front member having a matching front end surface for being seated and centered on said centering surface, thereby centering the mandrel or punch; and releasable lock means locking the annular means to the stem, the front member including means for unlocking the locking means, for being released upon advance of the stem and upon abutment of said front end surface and said centerin surface.

2. Device as in claim 1, the lock means being a spring-biased ball lock, the stem having an annular groove to lockingly receive a ball of the ball lock.

3. Device as in claim 1, the lock means including at least one radially displaceable lock member, guided into and running in the rear member and being actuated by the front member.

4. Device as in claim 1, the annular means or front member including a frusto-conical front end for centering on a corresponding conical shoulder in the die cavity, thereby also defining an axial limit position of advance for the annular means.

* * * * *